US006220043B1

(12) United States Patent
Chaney, Jr. et al.

(10) Patent No.: US 6,220,043 B1
(45) Date of Patent: Apr. 24, 2001

(54) APPARATUS AND METHOD FOR CONTROL OF A HEAT PUMP SYSTEM

(75) Inventors: Robert K. Chaney, Jr., Garland, TX (US); Mitchell R. Rowlette, Berea; Mark E. Miller, Versailles, both of KY (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/326,911

(22) Filed: Jun. 7, 1999

Related U.S. Application Data

(60) Provisional application No. 60/093,885, filed on Jul. 23, 1998.

(51) Int. Cl.[7] ..... F25B 49/02

(52) U.S. Cl. ..... 62/182; 62/126; 62/158

(58) Field of Search ..... 62/156, 180, 182, 62/157, 228.3, 160, 158, 126, 127, 129, 130, 128; 165/240, 241, 242

(56) References Cited

U.S. PATENT DOCUMENTS 2,713,250 * 7/1955 Blatchford ..... 62/160
3,068,661 * 12/1962 McGrath ..... 62/156
4,563,877 * 1/1986 Harnish ..... 62/156 X
4,662,184 * 5/1987 Pohl et al. ..... 62/156
5,065,593 * 11/1991 Dudley et al. ..... 62/182
5,321,957 * 6/1994 Moore ..... 62/228.3
5,488,218 * 1/1996 Olsen et al. ..... 62/240 X
5,530,615 6/1996 Miller et al. .
5,743,100 * 4/1998 Welguisz et al. ..... 62/182 X
5,758,507 * 6/1998 Schuster et al. ..... 62/156 X

* cited by examiner

*Primary Examiner*—Harry B. Tanner
(74) *Attorney, Agent, or Firm*—Russell E. Baumann; Frederick J. Telecky, Jr.

(57) ABSTRACT

An integrated heat pump and electrical heat control (12) has thermostat signal inputs (O, W1, W2, G, Y) along with a defrost sensor input (DF_IN). The defrost sensor (22) is located in an outdoor unit (4) which also includes a compressor contactor (CC), condenser fan (16) and reversing valve (18) relays (K4, K3, K2) controlled by micro-controller (U1). The normally closed condenser fan relay (K3) is energized through the defrost sensor forming a hardware lock-out in which the defrost sensor contacts must be closed for relay (K3) to be actuated de-energizing the condenser fan. The compressor contactor (CC) is energized through a low pressure switch (24) and high pressure switch (26) forming another hardware interlock. The evaporator fan is energized by relay (K1) controlled by micro-controller (U1) and matched to the compressor for improved efficiency and comfort.

3 Claims, 8 Drawing Sheets

Microfiche Appendix Included
(1 Microfiche, 24 Pages)

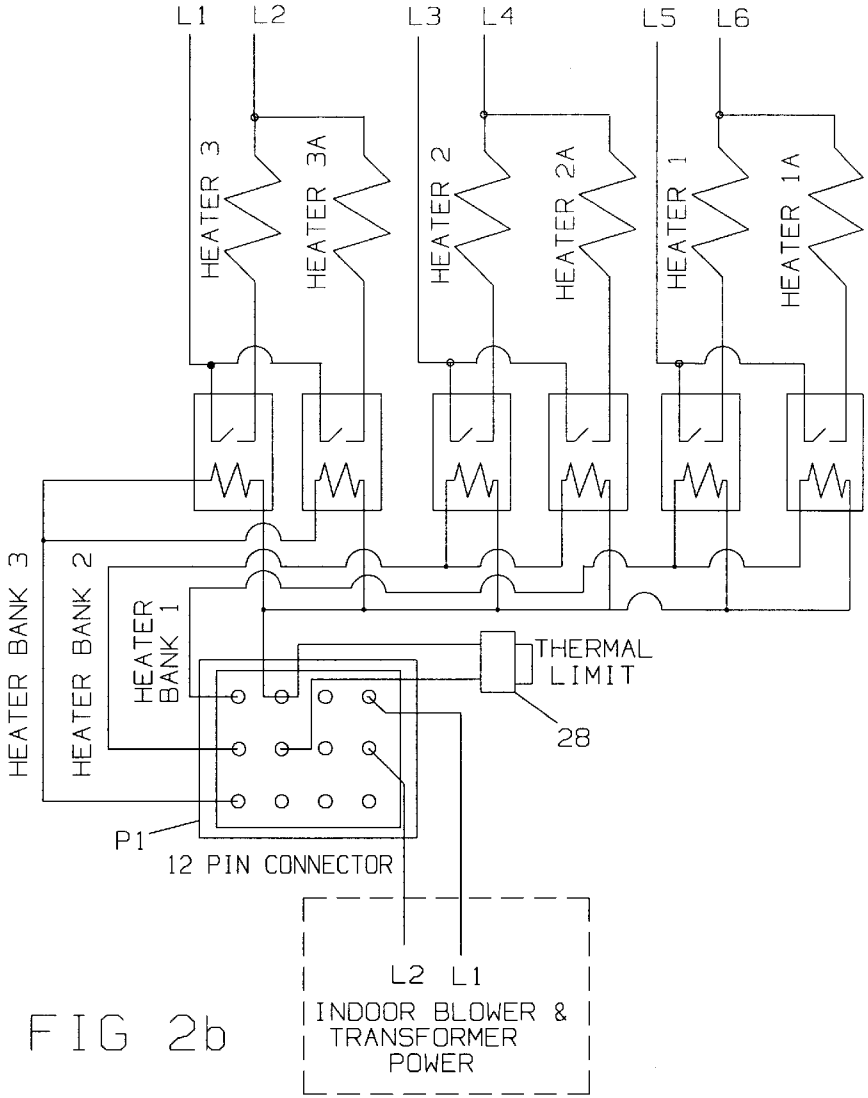
FIG 2b
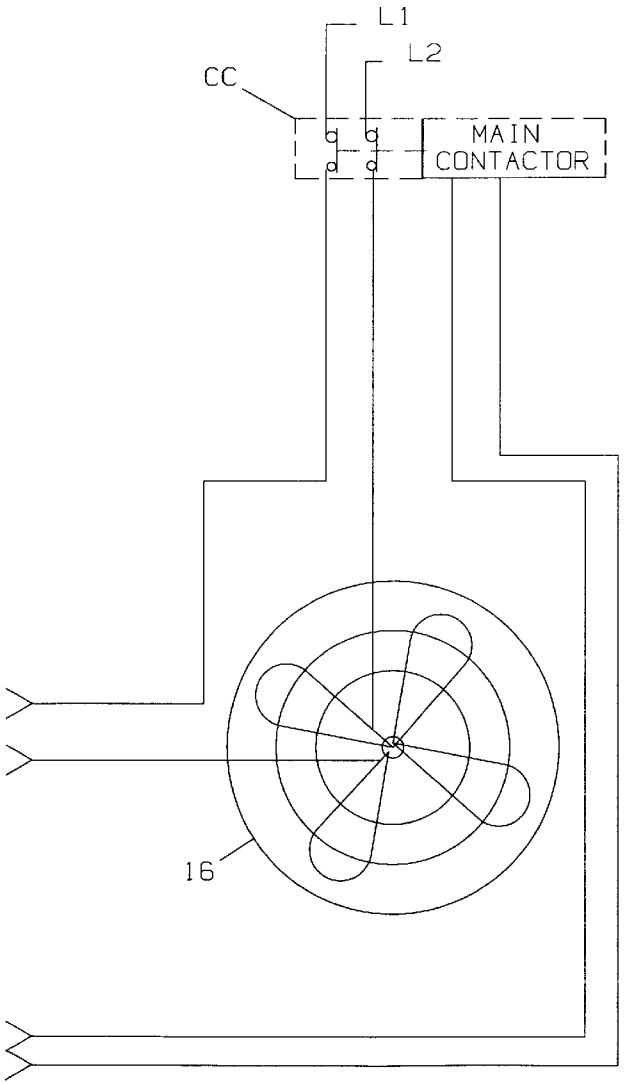

APPARATUS AND METHOD FOR CONTROL OF A HEAT PUMP SYSTEM

This application claims priority under 35 USC Section 119 (e) (1) of provisional application number 60/093,885 filed Jul. 23, 1998.

A microfiche appendix comprises 24 sheets of microfiche.

FIELD OF THE INVENTION

This application relates generally to heating, ventilating and air conditioning (HVAC) systems and more particularly to micro-controller based controls for heat pumps and electric furnaces.

A microfiche appendix is included totaling—microfiche and—frames

BACKGROUND OF THE INVENTION

The use of electronics in HVAC systems has become increasingly common in recent years and has grown to include heat pumps and electric furnaces. The use of electronics, with relays, to control electric heat, has only recently become practical through the use of zero, or near zero, voltage crossing switching techniques such as those disclosed and claimed in co-assigned U.S. Pat. No. 5,530,615, the contents of which is included herein by this reference. With respect to defrost controls, electronics have replaced electro-mechanical controls for a considerable period of time.

Conventional split systems for residential heat pumps have an indoor evaporator coil unit and an outdoor condenser coil unit with electronic controls for each unit receiving an input from a wall thermostat for either heating or cooling and for operating outputs such as electric resistive heat, fans, reversing valves and a compressor. Typically, some seven wires are required to interconnect the thermostat and the indoor control with six wires running out to the outdoor unit. It would be very desirable to reduce the wiring complexity from a standpoint of cost saving but also because many field failures occur due to miswiring during installation and decreasing the wiring connections would result in fewer failures. Even when the wiring is done correctly, however, there are undesirable functional limitations of the conventional control system. Ideally, the indoor fan should not be energized when the compressor is not operating, however, there are certain operational modes in which the indoor fan can be energized when the compressor is not energized such as in a lockout, either for a short or a long duration.

SUMMARY OF THE INVENTION

It is an object of the invention to provide apparatus and methods for controlling heat pumps and electric furnaces which overcome the above noted prior art limitations. Another object is the provision of such control apparatus and methods which result in improved efficiency of operation as well as an enhanced comfort performance. Yet another object of the invention is the provision of control apparatus and methods which result in fewer system components than conventional systems and with less complex wiring.

Briefly, in accordance with the invention, controls for the indoor and outdoor units are integrated into a single control with control of the evaporator (indoor) fan matched or synchronized with the compressor operation. The integrated control receives the defrost thermostat signal input from the outdoor unit and controls the reversing valve, condenser fan and compressor contactor by relays. This results in improved efficiency and comfort. For example, if the compressor has been shut off due to a pressure switch trip or anti-short cycle timer then the evaporator fan can be shut off during this period. This improves system efficiency because the heat convection transferal is maximized to a specific set point, a feature not available in conventional split system controls. In the heat mode, supplemental electric heat can also be energized. Additionally, the evaporator fan speed can be varied during defrost to improve comfort. Complete control of the electric heat, indoor fan, outdoor fan, reversing valve and compressor allows optimum control of the defrost operation in a manner not available in conventional systems. The electric heat can be initialized in anticipation of defrost, the outdoor fan can be enabled in anticipation of completion of defrost, and the reversing valve can be used to equalize system pressures at the end of each cycle.

Conventional heat pumps have been known to result in discomfort due to the limitations of the refrigerant. This problem is obviated by an integrated control made in accordance with the invention by synchronizing operation of the compressor and evaporator fan. For example, allowing the compressor to run allows the refrigerant to transfer heat to the heat exchanger. After the compressor has been running for a selected time, e.g., 30 seconds, the indoor fan is enabled thereby providing a warmer discharge air.

The control detects air flow problems due to improper installation, indoor (evaporator) fan failure and "stuck" on resistive heaters. If the thermal limit switch opens, the indoor blower fan is energized. If the switch opens for a continuous duration of a selected amount, e.g., 80 seconds, then the system is put into a hard lockout which maintains the indoor fan running and prevents the electric heat from being turned on. In addition, during any mode of operation, if the thermal limit switch opens and recloses four times, the system is put into a soft lockout which allows the evaporator fan to cycle with demand for heat/cool but prevents the electric heat from being turned on for a selected period, e.g., one hour. If, after one hour, the limit has not switched open, the counters are cleared and the heaters can be enabled.

The control is provided with on board diagnostics which can monitor all limit devices, pressure and thermal switches, and can provide a central location for troubleshooting.

BRIEF DESCRIPTION OF THE DRAWINGS

FIGS. 2*a* and 2*b* together are a system connection diagram showing an integrated control, made in accordance with the invention, interconnected with a heat pump and an electric furnace;

DETAILED DESCRIPTION OF THE PREFERRED EMBODIMENT

Figure 1:
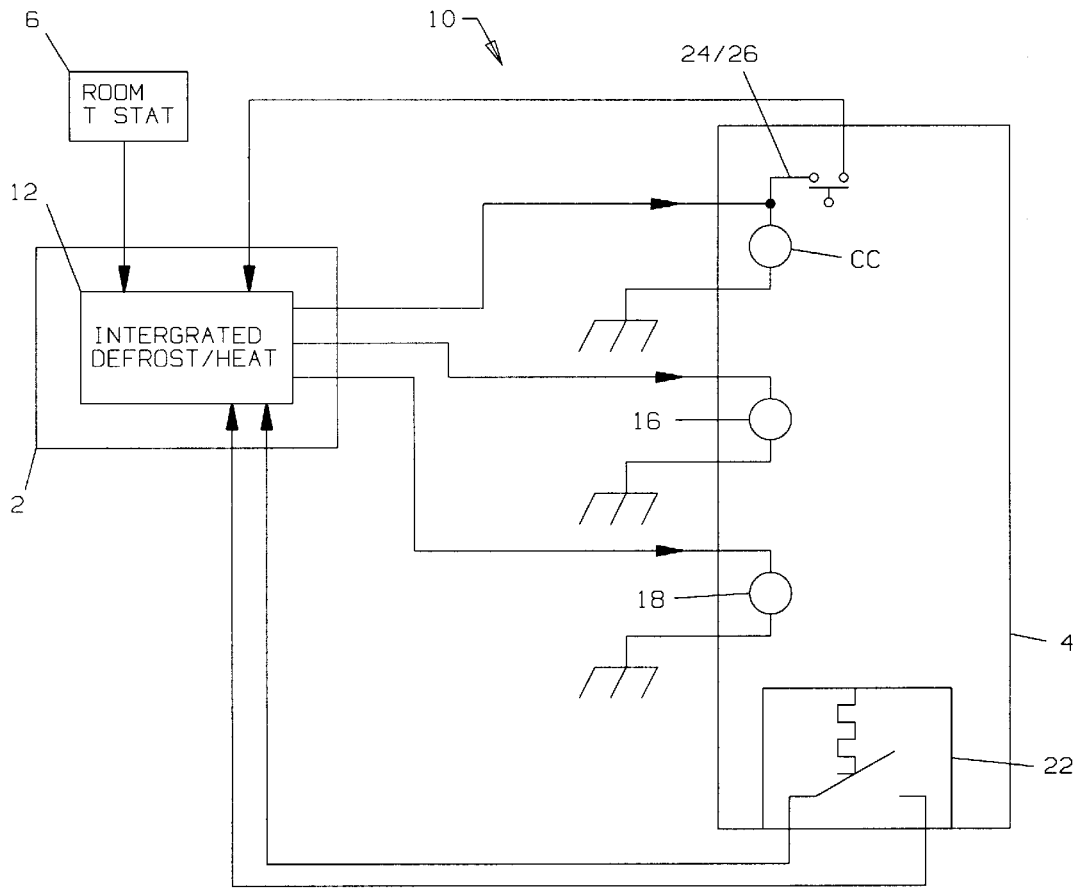
FIG. 1 is a simplified schematic block diagram showing a heat pump and electric heat furnace system having indoor and outdoor units and using an integrated control made in accordance with the invention.
Figure 1A:
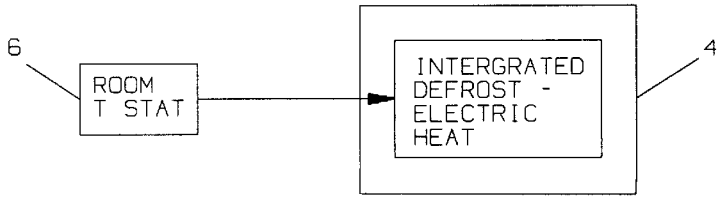
FIG. 1*a* is a schematic block diagram showing an integrated control disposed in an outdoor unit.
Figure 2A:
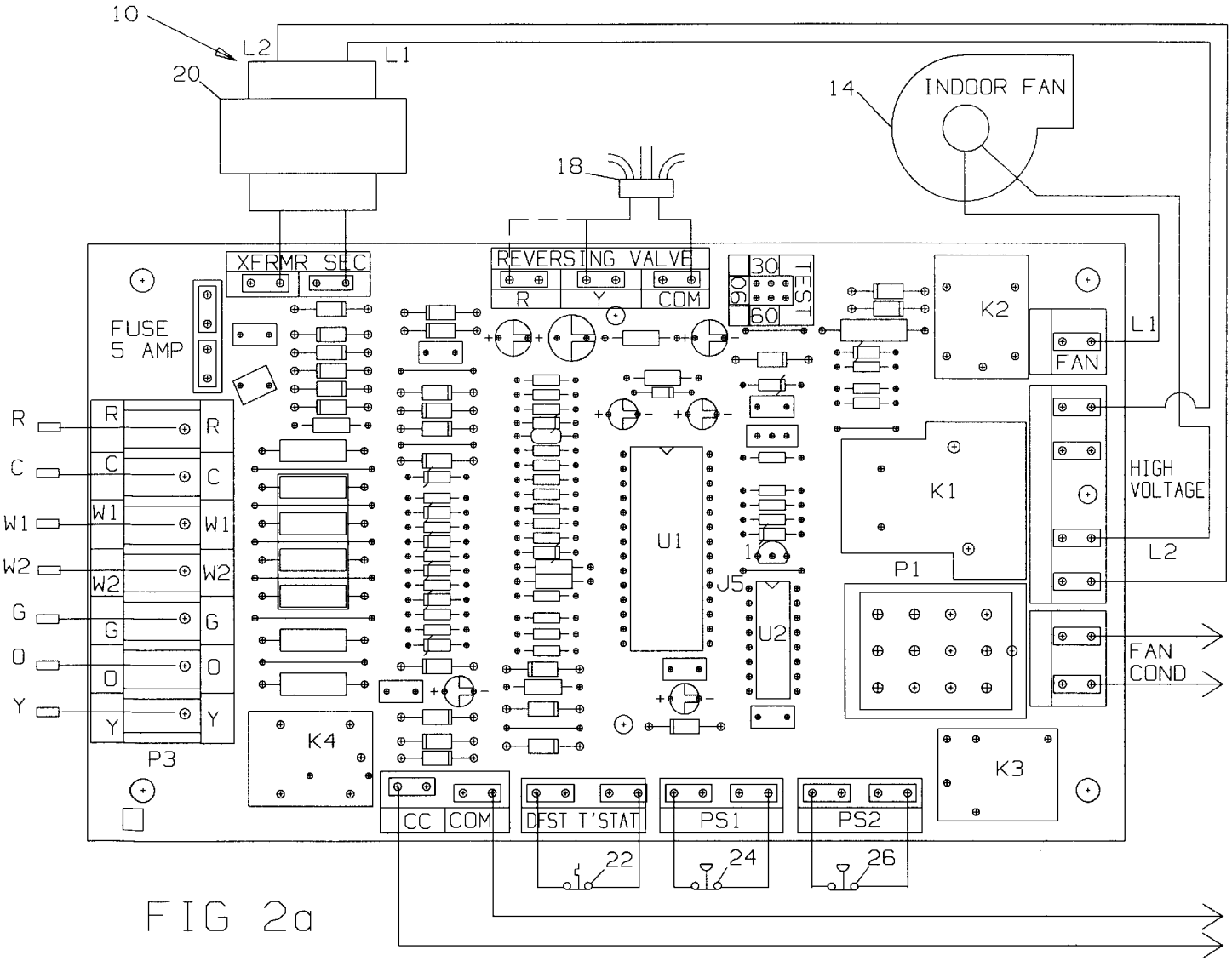

With reference to FIG. 1, a heat pump and electric furnace split system 10 comprises an electronic control 12 mounted in an indoor unit 2 with input signals to control 12 from room thermostat 6, pressure sensor 24 and/or 26 and defrost sensor 22 disposed in an outdoor unit 4. Outputs from control 12 are coupled to compressor contactor CC, condenser fan 16 and reversing valve 18 in the outdoor unit as well as components in the indoor system shown in FIG. 2. More specifically, with respect to FIG. 2, an evaporator (indoor) fan 14, condenser fan 16, reversing valve 18, wall thermostat connections R, C, W1, W2, G, O and Y, main contactor CC and a transformer 20 are shown along with defrost thermostat 22, low pressure switch 24 and high pressure switch 26 interconnected with control 12. Heater banks 1, 2 and 3, each comprising first and second heating elements (Heaters 1, 1A, 2, 2A, 3, 3A, respectively), are shown connected to pin connector P1 along with a thermal limit switch 28. Inputs to the control comprise R, 24 VAC, line frequency 50/60 Hz; C, 24 VAC common; Y, first stage (heat pump) heating; O, cooling; G, indoor or evaporator fan; W1, first stage supplemental heat; W2, second stage supplemental heat; DFST T'STAT, liquid line sensor switch for defrost; LIM IN, thermal limit switch; PS1 and PS2, high and low pressure switch cut-outs; 30, 60 and 90 MIN field selectable defrost inhibit timer pins with the default value when no shunt jumper is used being 90 minutes; TEST, defrost timer speed-up; TEST_IN, electric heat speed-up time; and L1, L2, high voltage 240 VAC. The outputs comprise CC, compressor contactor relay; reversing valve R or Y terminals; HTR1, heater bank 1; HTR2, heater bank 2; HTR3, heater bank 3; COND FAN, outdoor condenser fan; and FAN, indoor (evaporator) air handler fan.

Figure 3A:
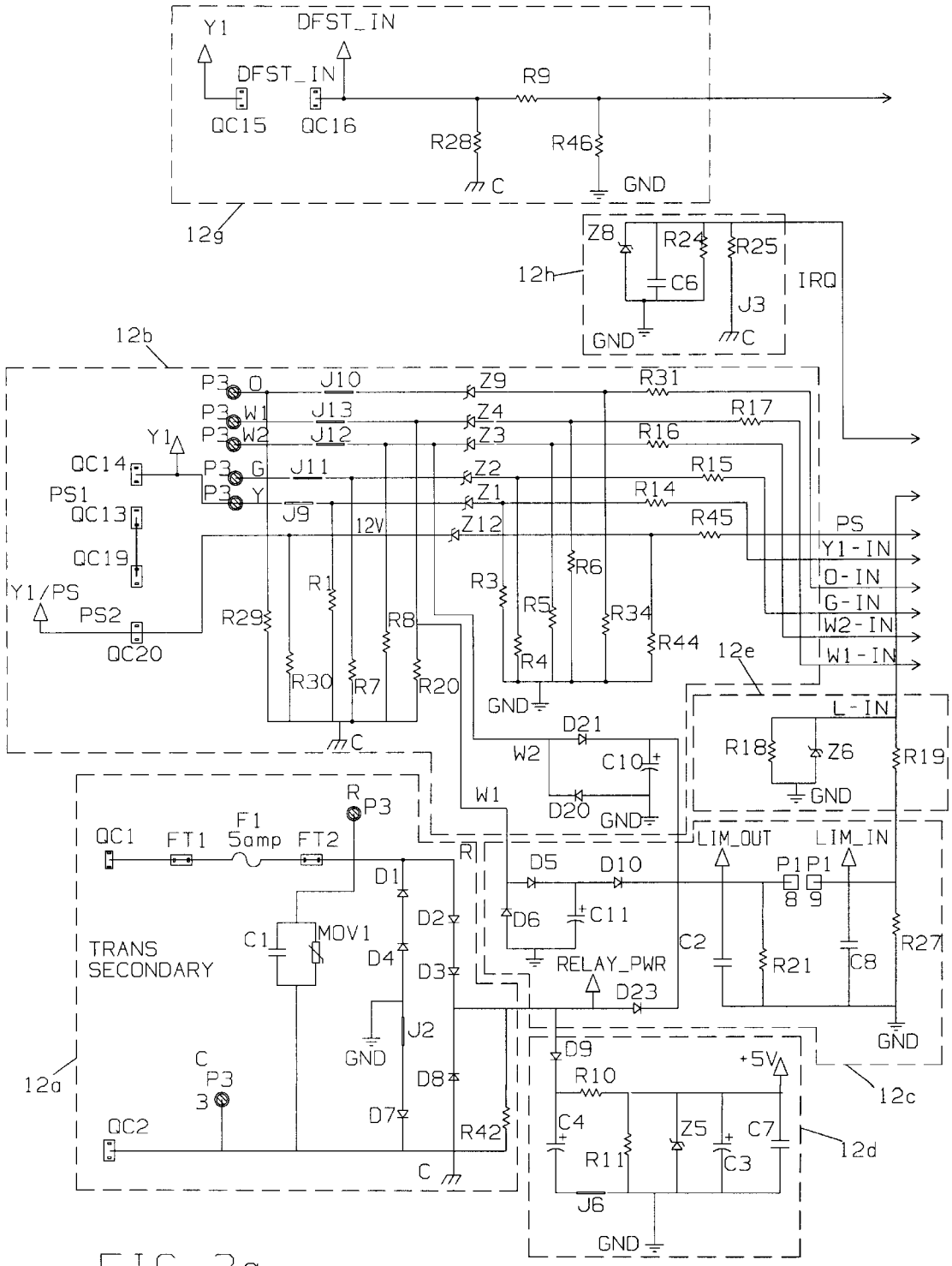
FIGS. 3*a*, 3*b* and 3*c* together are a schematic wiring diagram of the FIGS. 1–2*b* integrated control.
Figure 3B:
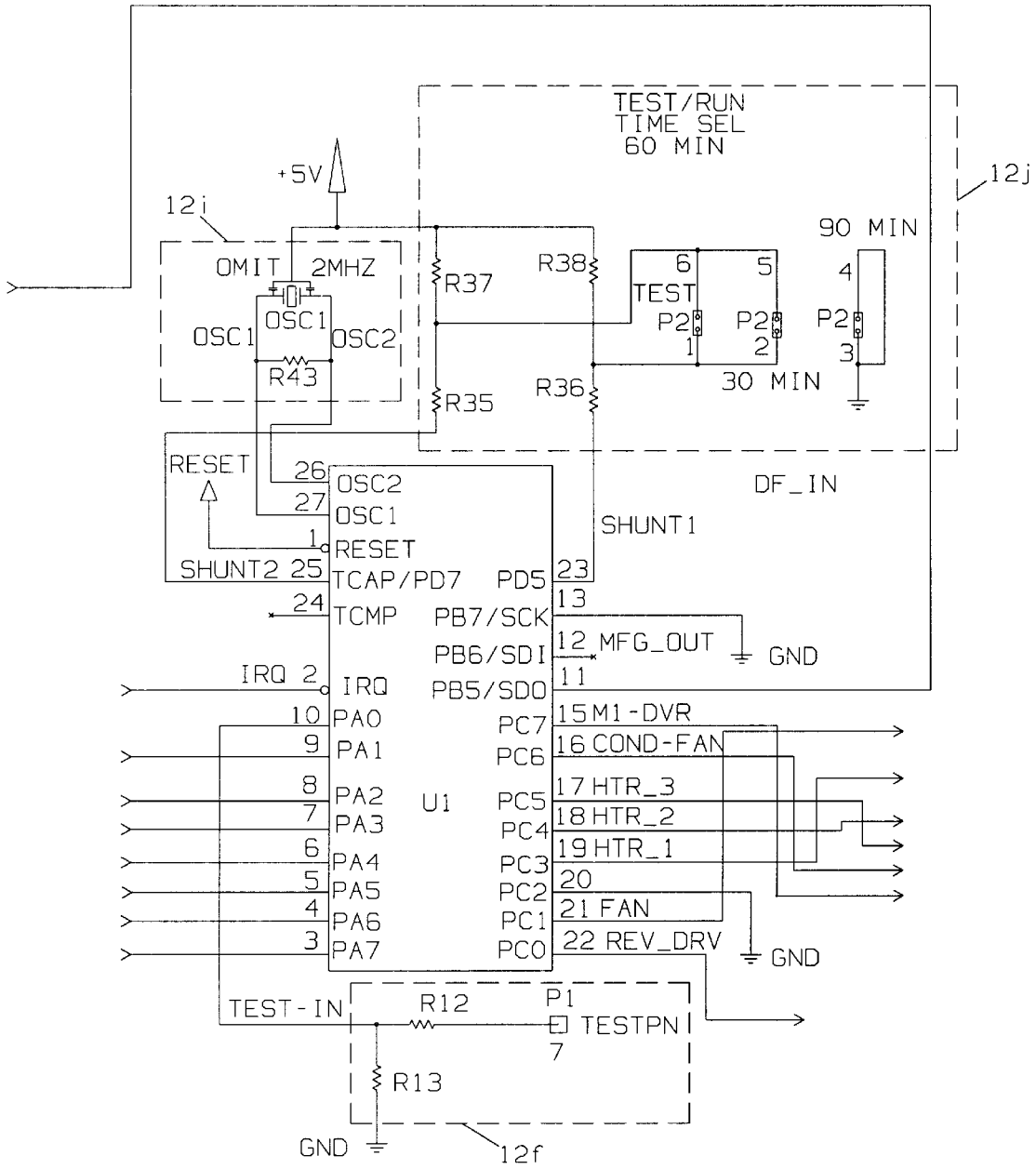
Figure 3C:
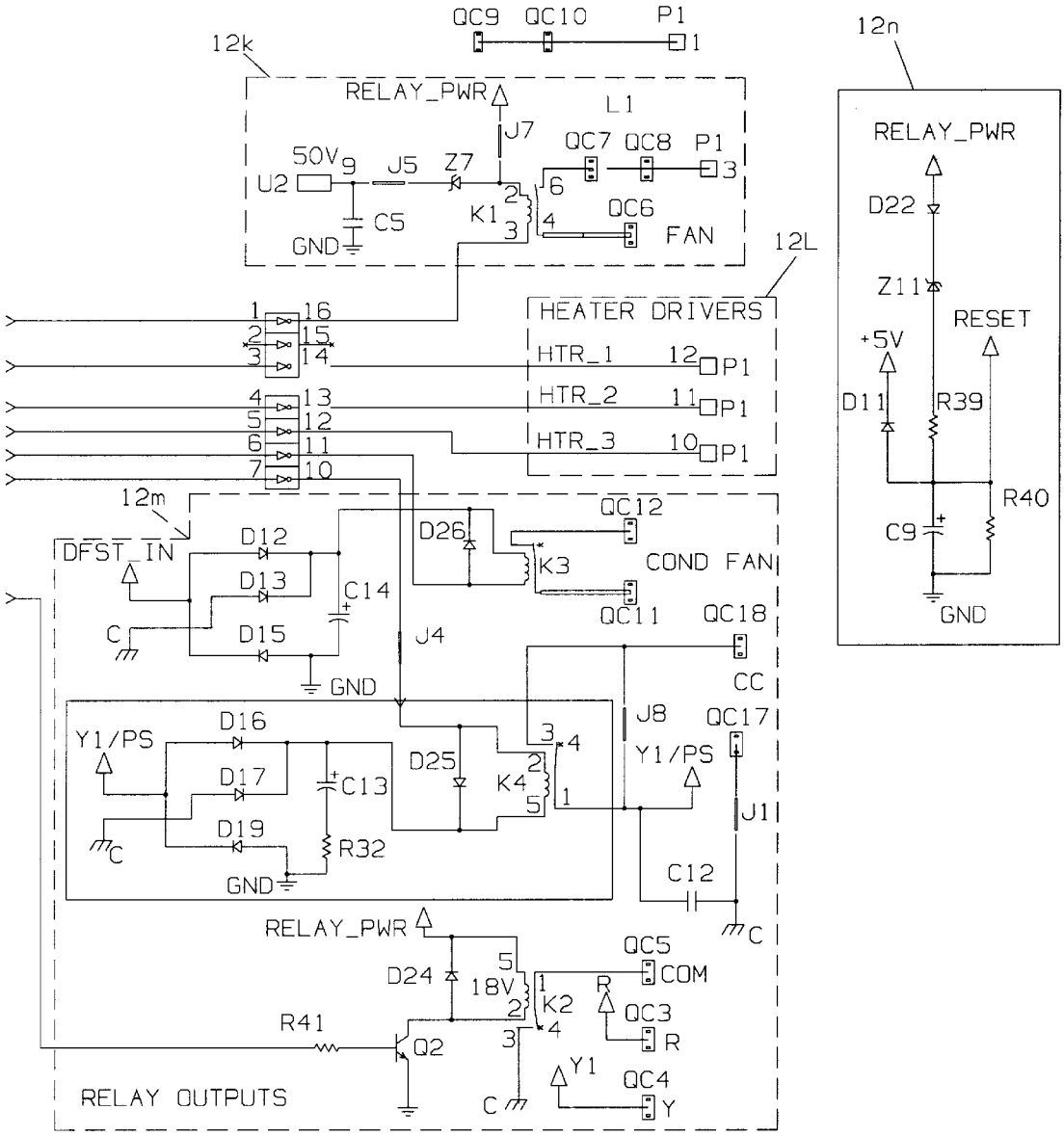

Electronic controller 12, shown in FIGS. 3A and 3B, comprise the following sections demarcated by dashed lines: Power Supply Circuit Section 12*a*, Thermostat Input Section 12*b*, Relay Power Output Section 12*c*, Logic Voltage Output Section 12*d*, Limit Input Section 12*e*, Test Input Section 12*f*, Defrost Sensor Input Section 12*g*, 60 Hertz Clock Section 12*h*, Oscillator Section 12*l*, Shunt Select Input Section 12*j*, Indoor Blower Fan Relay Output Section 12*k*, Heater Driver Section 12*l*, Relay Output Section 12*m* and Reset Circuit Section 12*n*.

Power Supply Circuit Section 12*a*

Power Supply Input Section 12*a* includes terminals QC1, QC2 for connection to the secondary of transformer 20 which supplies 24 volts. Fuse F1, connected to the 24 volt AC input, protects the electronics and the transformer. The fused voltage is inputted into diodes D1–D4, D7 and D8 configured as a full wave rectifying circuit. The output of the rectifier feeds into Logic Voltage Output Section 12*d* and Relay Power Output Section 12*c*.

Logic Voltage Output Section 12*d*

Logic Voltage Output Section 12*d* is separated from the rectifying bridge by diode D9. Downstream from diode D9 is a capacitor C4 used to smooth out the rectified AC power. The resulting DC voltage is regulated down to 5 volts by current limiting resistor R10 and a zener diode Z5. Capacitor C3 and C7 are used to filter out any voltage ripples that occur in the logic level supply. The circuit outputs 5 VDC across both capacitors C3 and C7.

Relay Power Output Section 12*c*

Relay Power Output Section 12*c* is separated from the rectifying bridge by diode D23. Capacitor C2, C10, C11 and C8 smooth the voltage from diode 23 providing an unregulated, rectified power source for several DC relays controlled by electronic control 12, to be discussed.

Thermostat Input Section 12*b*

The thermostat inputs receive a 24 VAC input when on and an earth ground signal when off. The inputs O, W1, W2, G, Y and PS all use a nearly identical circuit. Components R29, R20, R8, R7, R1 and R30 are pull down resistors that provide a reference to earth ground. Next in the circuit are zener diodes Z9, Z4, Z3, Z2, Z1 and Z12, respectively. The zener diodes are used to set a voltage threshold for the input signals and assure that the inputs have reached a certain minimum voltage level before they can be read at the micro-controller. Resistors R34, R6, R5, R4, R3 and R44, respectively, are used to load down the zener diodes. Resistors R31, R17, R16, R15, R14 and R45, respectively, are tied to input pins 6 (PA4), 3 (PA7), 4 (PA6), 5 (PA5), 7 (PA3) and 8 (PA2), respectively of micro-controller Ul. These resistors serve to limit the current that can be inputted into micro-controller Ul and protect the micro-controller's inputs from electrical stress.

Defrost Sensor Input Section 12*g*

Resistor R28, connected between terminal QC16 and earth ground, is used to reference the signal to earth ground while resistors R9 and R46 current limit the input (pin 11, PB5) and protect micro-controller U1 from electrical stress. The defrost sensor, thermostat 22 is closed during defrost cycles and loaded at 50 mA through fan relay K3, to be discussed below.

60 Hertz-Clock Section 12*h*

Clock Section 12*h* connected to micro-controller U1 at $\overline{\text{IRQ}}$ (pin 2 of micro-controller U1) is used to link earth ground to the logic ground of the micro-controller. The earth ground input provides a 60 Hertz signal that is used as a clock input. Resistors R25 and R24 provide current protection and a voltage reference for the micro-controller input. Zener diode Z8 limits the voltage and capacitor C6 aids in filtering electrical noise into controller U1.

Oscillator Section 12*i*

Resistor R43 and resonator OSC1, connected between OSC1 and OSC2 micro-controller inputs (pins 27, 26), provide the internal clock for the controller.

Limit Input Section 12*e*

The state of the thermal limit 28 is monitored by micro-controller U1. Thermal limit 28 is used to break power to the relays being used to control auxiliary heat, i.e., heater banks 1, 2 and 3, as well as to provide an input at pin 9 (PA1) to the micro-controller which indicates the temperature conditions in the air handler of the system. The state (on/off) is inputted to the micro-controller via resistor R19. Resistor R18 and zener diode Z6 are used to reference the input to logic ground and to limit its potential to 5 volts (logic voltage).

Test Input Section 12*f*

The test input, pin 10 (PAO) of micro-controller 12, is used in the manufacture of the controller and by the user. The status of this input is used by the controller to access special operation timings needed to run final assembly tests. The circuit comprises resistor R12 used to current limit the input to the controller and R13 used to reference the signal to logic ground.

Indoor Blower Relay Section 12K

Indoor blower fan 14 is controlled through relay K1 which is a normally open relay activated by micro-controller U1 via output pin 21 (PC1) and pins 1, 16 of relay driver U2.

The internal suppression diode (not shown) and zener Z7 are used to suppress the electro-magnetic field when the relay is released.

Heater Driver Section 12*l*

Electronic control 12, as shown, can accommodate up to six external relays. These are connected and controlled by micro-controller U1 via output pins 19, 18, 17 (PC3, PC4, PC5, respectively) and pins 3, 14; 4, 13 and 5, 12, respectively of relay driver U2 wired to connector P1. Two relays per output may be used.

Relay Output Section 12*m*

Condenser fan 16, the outdoor fan, is controlled by relay K3 which is normally closed and which maintains the fan energized or running in the deactivated state. When the relay is activated through micro-controller output pin 16 (PC6) and pin 6, 11 of relay driver U2, the condenser fan will be turned off. This is used during the defrost operation. Diodes D12, D13 and D15 are used to provide full wave rectified power to the relay coil (along with diode D7 of Power Supply Circuit 12*a*). Diode D26 is used to prevent back EMF from the relay into driver U2. The diodes are used since the power source for the relays is derived from the defrost thermostat, referenced supra. This provides a hardware interlock between the defrost sensor and the state of the condenser fan. If the defrost thermostat is not closed, the control cannot activate the condenser fan relay. Additionally, the circuit provides the advantage of placing electrical loading on the defrost thermostat contacts.

The system contactor CC is controlled by relay K4 through micro-controller output pin 15 (PC7) and pins 7, 10 of relay driver U2. The function of this relay is to inhibit operation of the compressor which is required between run cycles and during fault conditions. The operation of the relay is controlled by micro-controller U1, as noted, as well as the diode interlock provided by diodes D16, D17 and D19. Diode D25 is used to prevent back EMF from the relay into driver U2. If the Y1/PS signal, i.e., the pressure switch and Y signal combined, is not present (see QC20 of Thermostat Input Section 12*b*), the relay cannot be operated thereby providing a hardware interlock. An additional benefit is derived from this circuit, like that of relay K4 circuit, by adding loading to the Y1/PS input, i.e., the pressure switch contacts by means of the coil of relay 4 in parallel with capacitance C13.

Reversing valve 16 is controlled by normally open relay K2 through micro-controller output pin 22 (PCO) which is connected through current limiting resistor R41 to the base of transistor Q2. Diode 24 connected across the relay coil is used to suppress the electromagnetic field when the relay is released. Energization of relay K2 causes valve 16 to operate.

Reset Circuit Section 12*n*

Micro-controller U1 requires a special circuit connected to micro-controller pin 1 ($\overline{\text{RESET}}$) to handle the reset function during power up and power down cycles. This is accomplished by separating power from the relay power circuit through diode D22. Zener diode Z11 is used to set a minimum voltage threshold prior to activating the circuit. Resistor R39 is used to current limit the charging of capacitor C9. This acts to slow down the voltage rise during power up. Resistor R40 is used to pull down the circuit to logic ground during a power drop out. Diode D11 is used to clip the maximum voltage for the circuit to one voltage drop (0.7 volts) above logic voltage.

The control responds to thermostat inputs by turning the indoor fan on and delaying it off with the delay off being a timed function dependent upon the particular mode of operation. The control drives the off board heater relays which respond to the first and second supplemental heat requests. The heater elements are sequenced on based on the W1 and W2 inputs and in accordance with preselected timing.

Opening of the thermal limit which responds to over-temperature conditions in the air duct, results in the indoor fan instantly turning on. If the thermal limit opens and there still is a call for supplemental heat, the heaters will be disabled for a minimum preselected time of 10 seconds and then stage back on according to a predetermined sequence. The thermal limit must be closed for the heater relays to be re-enabled. A one hour soft lock-out occurs whenever the thermal limit opens a preselected number of times, e.g., four times. During the soft lock-out, the control disables all requests for heat. The four thermal limit counters can be cleared by either a power cycle of R and C or an on/off transition of W1, W2 or Y. A hard lock-out results in the indoor blower fan being locked on and the disabling of the heaters and can happen if, in the soft lock-out, the thermal limit trips open or if the limit remains open for a continuous duration of a preselected time of 80 seconds.

The TEST_IN input results in a one-time speed up mode. This is for factory installed heat or rapid cycling.

With respect to the heat pump and defrost controls, when PS1 and PS2 are closed and there is a request for Y, the contactor CC is enabled after a preselected five minute anti-short cycle timer which begins whenever Y transitions from an on/off condition. If either PS1 or PS2 opens, the control will disable CC and begin an anti-short cycle period. The defrost times are based on a cyclic timer which accrue only when pressure switches and Y are present and the anti-short cycle delay has expired. A request for O (cooling) enables the reversing valve.

Once the inhibit times have expired and there is a request for Y, then the defrost function is enabled and the condenser fan is disabled, the Y request on enables HTR1, HTR2 and HTR3 and the reversing valve is enabled. If the PS1 or PS2 switch opens during defrost and Y is present then the electric heat is disabled. The heat pump operates in the defrost mode only if the control is in the heating phase and the liquid line thermostat is closed. If the liquid line thermostat opens, the defrost functions are bypassed. Defrosting continues until either 10 minutes have expired or the liquid line thermostat (thermal cut-out) opens. Termination of defrost clears all timers and restarts the inhibit period. The following sequence occurs, the supplemental heat is turned off, the condenser fan is enabled and the reversing valve is de-energized after a selected time delay (e.g., 8 seconds).

If the TEST selection is shunted the control will clear all thermal lock-outs and if Y is on will allow a speed-up mode of the heat pump's defrost cycle for a selected number of cycles (e.g., 8 cycles).

Figure 4:
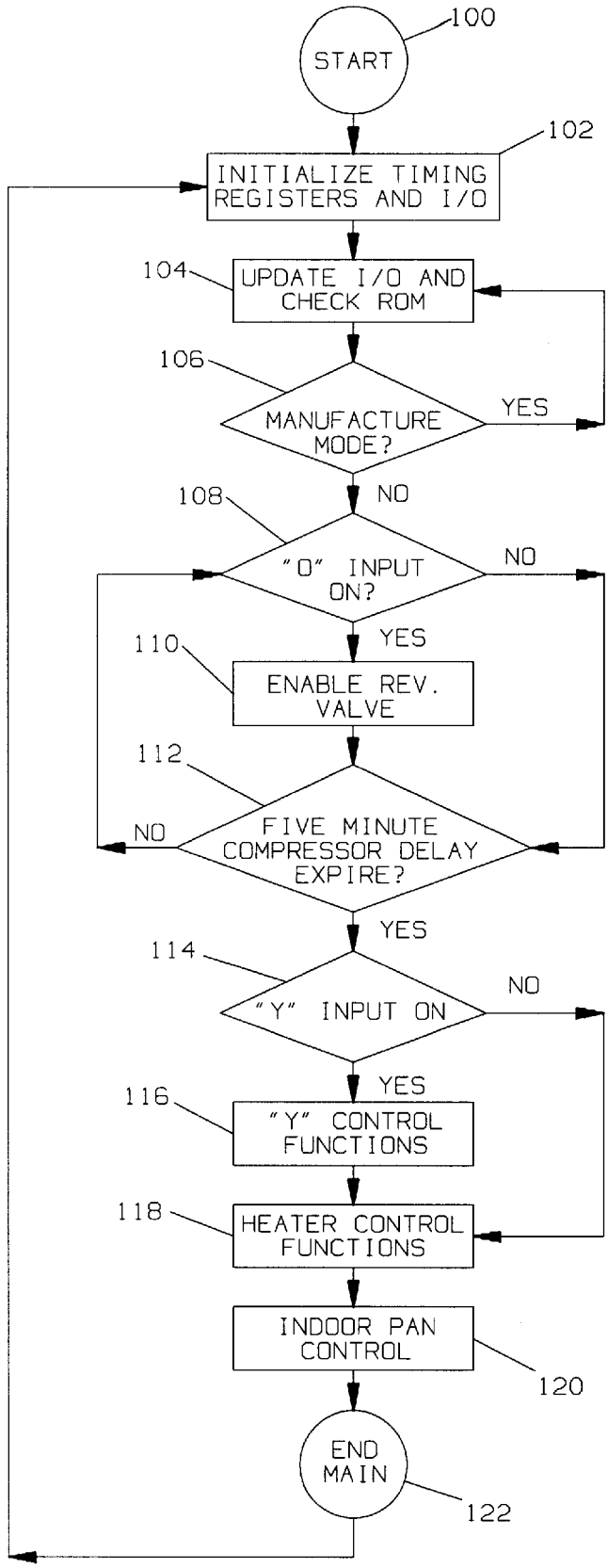
FIG. 4 is a flow chart showing the main program of a system made in accordance with the invention.

With reference to FIG. 4, the main program starts at 100 and at step 102 timing registers and inputs/outputs are initialized. At the next step, 104 the inputs/outputs are updated and the ROM is checked. At decision step 106, if the control is in the manufacturing mode the program returns to step 104, if not, it moves to decision step 108 which looks at whether an O (cooling) input is present. If not, the program goes to decision step 112, to be discussed. If the O input is present the program goes to process step 110 which enables the reversing valve and then moves on to decision block 112 which looks to see if the five minute anti-short cycle compressor delay has expired. If the delay has not expired the program reverts back to step 108 but if the delay has expired the program goes to decision block 114 which looks to see if the Y (compressor) input is present. If not, the program goes to process step 118 to be discussed but if it is present the program goes to process step 116, compressor contactor functions and step 118, heater control functions and then on to step 120 controlling the indoor fan control. The program ends at 122 and cycles back to step 104.

Figure 5:
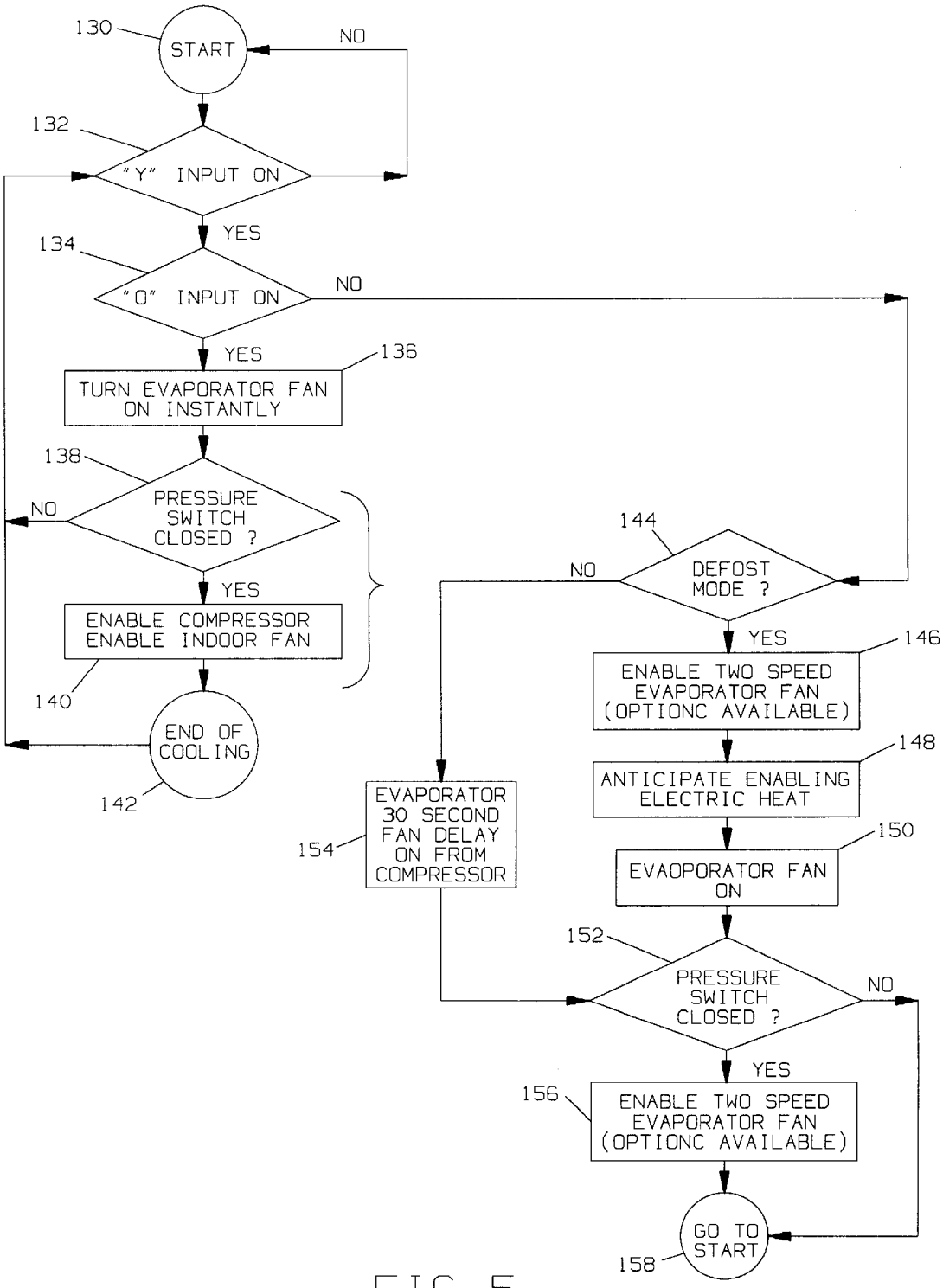
FIG. 5 is a flow chart showing the integration of the several components of the system.

With reference to FIG. 5 which shows the flow diagram for the integration of the system's components, the program starts at 130 and at decision block 132 looks to see if there is a Y input signal. If not, the program cycles back to the start but if the Y signal is present the program moves on to decision block 134 which looks to see if there is an O input. If there is no cooling signal the program jumps to decision block 144, to be discussed. If there is an O input the next step at 136 is to instantly turn on the evaporator fan. The program then goes on to decision block 138 and checks to see if the pressure switches are closed and if not the program cycles back to decision block 132. If the pressure switches are closed then the compressor and the indoor fan are enabled at process step 140. The cooling cycle then ends at 142 and the program cycles back to decision block 132.

When the decision block 134 finds that there is no O input, the program jumps to decision block 144, as mentioned above, which determines whether the control is in the defrost mode. If the answer is negative the program jumps ahead to process step 154 in which the evaporator fan 30 second delay on is initiated. If the answer in process step is positive the program goes to process steps 146, 148 providing selected optional features, i.e., enable a two-speed evaporator fan, if desired, of step 146 and/or enabling anticipatory electric heat of process step 148. The evaporator fan is enabled in process step 150 with the program going on to decision step 152 to check on the status of the pressure switches. If the pressure switches are closed the program goes to step 156 providing an optional process step of enabling a two speed compressor. The program then goes to 158 which cycles back to start at 130. If the pressure switches are not closed the program skips block 156.

The decision steps 138 and 152 looking at the status of the pressure switches as a precursor of enabling the compressor results in the feature of being able to run the indoor or evaporator fan in synchronization with the compressor and is not available in conventional controls. The decision block 144 in which the status of defrost is checked allows the control to distinguish between a defrost cycle and an auxiliary heat cycle (signals W1, W2). This feature is also not available in conventional controls. In accordance with the invention, the defrost cycle can be handled differently than in prior art controls with regard to electric heat staging, changing fan speeds or compressor speeds (steps 146, 148, 150) to optimize the defrost cycle for efficiency and comfort reasons.

Efficiency ratings serve as design parameters of heat pumps. The ratings can be maximized by having complete control of the total system by merging the electric heat/fan control board and the defrost control as described above. The control of the evaporator (indoor) fan, is, as a result, matched to the compressor operation. Because of the integration, the fan can be inhibited when the compressor is not running due to pressure switch trips or anti-short cycle periods. This improves system efficiency because the heat convection transfer is maximized to a specific set point. Conventional split system controls do not have this capability. Furthermore, conventional heat pumps have been known to result in discomfort due to the limitations of the refrigerant. This problem is obviated by controlling the compressor together with the evaporator fan. As mentioned above, by allowing the compressor to run, the refrigerant is allowed to transfer heat to the heat exchanger. The heat exchanger will blow air for a selected period of time, e.g., 30 seconds, after the compressor has been running. Once this time delay expires, the indoor fan is enabled providing a warmer discharge air.

Complete control of the electric heat, indoor fan, outdoor fan, reversing valve and compressor allows optimum defrost operation. The electric heat can be initialized in anticipation of defrost, the outdoor fan can be enabled in anticipation of completion and the reversing valve can be used to equalize system pressures at the end of each cycle.

The control of the present invention allows the control to detect air flow problems due to improper installation, indoor fan failure and stuck-on resistive heaters. If this switch opens, the indoor blower fan is energized. If this switch opens for a continuous duration of 80 seconds, then the system is put into a hard lock-out in which the indoor fan remains on and inhibits the electric heat from turning on. In addition, during any mode of operation, if the thermal limit opens and recloses four times, the system is put into soft lock-out in which the evaporator fan still cycles with the demand for heat/cool, but the electric heat is inhibited for one hour. If, after one hour, the limit has not switched open, the counters will be cleared and the heaters can be enabled.

Table A comprises a list of components used in a control 12 made in accordance with the invention.

| QTY | Description | |
|---|---|---|
| 001 | CEM-1 PCB Board | Board |
| 019 | ¼ QUICK CONNECTS | QC2 QC3 QC4 QC5 QC6 QC7 QC8 QC9 |

-continued

Table A comprises a list of components used in a control 12 made in accordance with the invention.

| QTY | Description | |
|---|---|---|
| | | QC10 QC11 QC12 QC13 QC14 QC15 QC16 QC17 QC18 QC19 QC20 |
| 001 | 3/16 QUICK CONNECTS 20 MIL | QC1 |
| 001 | 12 PIN MATE & LOK | P1 |
| 001 | 5 AMP FUSE | F1 |
| 002 | VERT FUSE TERMINAL | FT1 FT2 |
| 001 | MPSA06 OR EQUIV (TAPE AND | Q2 |
| 002 | RES, 1K, ¼ W, 1% | R32 R39 |
| 004 | RES, 10K, ¼ W, 1% | R19 R21 R27 R42 |
| 013 | .022 JUMPER, NON-INSULATE | J1 J2 J3 J4 J5 J6 J7 J8 J9 J10 J11 J12 J13 |
| 023 | 1N4007 DIODE | D1 D2 D3 D4 D5 D6 D7 D8 D9 D10 D12 D13 D15 D16 D17 D19 D20 D21 D22 D23 D24 D25 D26 |
| 001 | HASCO SSD110PHDC24-14 | K3 |
| 003 | ZENER, 1N5231, 5% .5 w | Z5 Z6 Z8 |
| 006 | ZENER, 1N5242, 5% .5 w | Z1 Z2 Z3 Z4 Z9 Z12 |
| 001 | ZENER, 1N5247, 5% .5 w | Z11 |
| 001 | ZENER, 1N5260, 5% .5 w | Z7 |
| 001 | MOTOROLA MC68HC705P9 | U1 |
| 001 | ULN 2003A RELAY DRIVER | U2 |
| 002 | 18 V P&B SPDT T7C RELAY | K2 K4 |
| 007 | RES, 10K, ⅛ W, 5% | R3 R4 R24 R25 R34 R40 R44 |
| 010 | RES, 100K, ⅛ W, 5% | R9 R12 R14 R15 R16 R17 R31 R37 R38 R45 |
| 001 | RES, 1M, ⅛ W, 5% | R43 |
| 004 | RES, 2K, ⅛ W, 5% | R11 R35 R36 R41 |
| 005 | RES 51K, ⅛ W, 5% | R5 R6 R13 R18 R46 |
| 001 | CRYSTAL OSC, 2.0 MHZ. | OSC1 |
| 001 | CERM CAP Z5U .01 Uf, 50 V | C6 |
| 006 | RES, 1.5K, 2 W, 5% | R1 R8 R10 R20 R28 R29 |
| 002 | RES, 2K, 2 W, 5% | R7 R30 |
| 001 | .025 DUAL ROW HEADER (6 P | P2 |
| 004 | STANDOFFS (PLASTIC) | S1 S2 S3 S4 |
| 003 | POST STANDOFF (PLASTIC SU | S5 S6 S7 |
| 002 | 10 uF, 16 V ELECTL RAD CAPS | C3 C9 |
| 002 | 10 uF, 50 V ELECTL RAD CAPS | C13 C14 |
| 002 | 47 uF, 50 V ELECTL RAD CAPS | C4 C11 |
| 001 | 100 uF, 50 V ELECTL RAD CAP | C10 |
| 001 | DIODE 1N458A (TAPE AND RE | D11 |
| 001 | MOV FOR 24 VAC APPS (SIEME | MOV1 |
| 005 | .1 uF, 100 V FILM CAP, 20% | C1 C2 C5 C7 C8 |
| 001 | .47 uF, 63 VDC FILM CAP | C12 |
| 001 | AUGAT TERMINAL BARRIER ST | P3 |
| 001 | RELAY, SPST, PCB MOUNT T9 | K1 |

Although the invention has been described with respect to a specific preferred embodiment thereof, many variations and modifications will immediately become apparent to those skilled in the art. For example, although the integrated defrost, electric heat control is shown and described as being disposed in the indoor unit it could, if desired, be placed in the outdoor unit as well. It is therefore the intent that the appended claims be interpreted as broadly as possible in view of the prior art to include all such variations and modifications.

What is claimed:

1. A method of controlling a heat pump system using a micro-controller, the system having an indoor unit with an indoor fan relay and an outdoor unit having an outdoor fan relay, a compressor relay, a reversing valve relay, a defrost thermostat, a pressure switch, a thermal limit switch and an anti-short cycle time delay comprising the steps of matching the operation of the compressor to the operation of the indoor fan and separately controlling energization of the indoor fan in response to selected fault conditions.

2. A method according to claim 1 in which the fault condition is abnormal pressure and the pressure switch has electrical contacts serially connected to the compressor relay which open and close in dependence upon pressure level further comprising the step of de-energizing the indoor fan following a selected time delay after the pressure switch contacts open.

3. A method according to claim 1 in which the outdoor unit has an anti-short cycle time delay preventing energization of the compressor further comprising the step of de-energizing the indoor fan during an anti-short cycle time delay.

* * * * *

UNITED STATES PATENT AND TRADEMARK OFFICE

CERTIFICATE OF CORRECTION

PATENT NO. : 6,220,043 B1
DATED : April 24, 2001
INVENTOR(S) : Robert K. Chaney, Jr., Mitchell R. Rowlette, Mark E. Miller It is certified that error appears in the above-identified patent and that said Letters Patent is hereby corrected as shown below:

Title page,
Item [54], the title "APPARATUS AND METHOD FOR CONTROL OF A HEAT PUMP SYSTEM" is incorrect. The correct title should be "METHOD FOR CONTROL OF A HEAT PUMP SYSTEM".

Item [75], Timothy L. Anderson, who is also an inventor in this patent, was omitted. Timothy L. Anderson should be added as an inventor in this patent.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*